United States Patent [19]

Schafer et al.

[11] Patent Number: 4,621,945

[45] Date of Patent: Nov. 11, 1986

[54] HEAD CONTROL STAND

[76] Inventors: Christopher E. Schafer, 507 Guthrie, Adair, Iowa 50002; William P. Schafer, Menlo, Iowa 50164; Charles J. Schafer, Rte. 2, Adair, Iowa 50002

[21] Appl. No.: 690,581

[22] Filed: Jan. 11, 1985

[51] Int. Cl.[4] ..... E02B 11/00; E02B 13/00

[52] U.S. Cl. ..... 405/39; 405/37; 137/451

[58] Field of Search ..... 405/36, 37, 43–45, 405/39–41, 48, 49, 51, 89, 90, 92, 96, 97, 98, 91; 137/448, 451, 429; 47/48.5

[56] References Cited

U.S. PATENT DOCUMENTS

| | | | |
|---|---|---|---|
| Re. 27,353 | 5/1972 | Shettel | 405/36 X |
| 2,868,492 | 1/1959 | Volcov et al. | 137/451 |
| 2,896,904 | 7/1959 | Northup | 405/41 X |
| 2,923,308 | 2/1960 | Shohan | 405/39 X |
| 3,779,276 | 12/1973 | King | 405/39 X |
| 4,353,524 | 10/1982 | Spendlow | 405/51 |
| 4,484,728 | 11/1984 | Moore | 405/98 X |

FOREIGN PATENT DOCUMENTS

| | | | |
|---|---|---|---|
| 146005 | 7/1950 | Australia | 405/37 |
| 265701 | 11/1965 | Australia | 405/39 |
| 1404503 | 8/1975 | United Kingdom | 405/37 |
| 897933 | 1/1982 | U.S.S.R. | 405/37 |

*Primary Examiner*—Cornelius J. Husar
*Assistant Examiner*—Nancy J. Stodola
*Attorney, Agent, or Firm*—James D. Birkenholz

[57] ABSTRACT

In association with a subsurface drainage/irrigation tile system, a head control stand is provided to selectively control the flow of water through a drainage/irrigation tile system and in turn control the depth of the water table. An actuating unit which includes a water level sensor floating on the surface of the water table is disposed within a riser pipe which extends upward from a subsurface drainage tile. A valve disposed within the drainage tile is connected to the water level sensor and opens upon the sensor raising in response to a raising in the water table which allows water to flow through the valve and subsequently closes the valve upon lowering of the water table.

3 Claims, 3 Drawing Figures

HEAD CONTROL STAND

BACKGROUND OF THE INVENTION

1. Field of the Invention

The present invention relates generally to agriculture drainage irrigation equipment and more particularly to apparatus for controlling water flow within a drainage irrigation tile and the level of the water table in association with subsurface drainage and irrigation systems.

2. Description of the Prior Art

In the agricultural field, both the economic and environmental aspects of farming are becoming a predominate concern with local and national governmental controls and regulations beginning to exert significant influence. Water management and conservation is of a primary importance both in terms of conservation of existing ground water resources and external application of water usage. Typically, external water application to crops is accomplished by conventional irrigation techniques of either above ground spraying or ground level application. In given situations, it is critical to maintain a controllable ground water table level for proper irrigation and conservation of existing resources.

In conventional tile-pipe type ground drainage systems, typically these systems carry away all water reaching them, thus lowering the water table to their subsurface level within the ground. This often is not necessary nor desirable in terms of conservation of both natural water and irrigation water sources. The net result being an inefficient attempt to control the ground water level giving minimal or no control over the conservation of water and frequently wasteful removal of water from the ground. Thus there is a need for selective control of the ground water table in response to changing environmental conditions through equipment which is readily adaptable to conventional ground irrigation and drainage systems. Further, this equipment should be economical and require little or no maintenance.

SUMMARY OF THE INVENTION

There is provided a head control stand having a riser pipe connected to a section of conventional drain tile by a junction with a valve disposed within the junction and operated in response to changes in the water table level by an actuating unit housed within the riser pipe. The valve includes a seal ring disposed within the junction against which rests a metering plate with a flap resting on its inside surface. An O-ring surface extends around the circumference of the metering plate and engages the seal ring. The flap is held in place by two conventional bolt-nut assemblies which also hold a handle bracket which threadably receives a handle. The actuating unit includes a float attached to the flap via a flexible cord. The float rides on the surface of the water table within the riser pipe and is adjusted to open the flap as the water table rises above a predetermined level, thus allowing water to flow through the metering plate. As the water table level drops, the float is lowered, thus closing the flap against the metering plate and preventing water from flowing within this section of drainage tile. The metering plate may be inserted into the junction via the handle and is held in place by water pressure within the head unit and junction.

DESCRIPTION OF THE PREFERRED EMBODIMENT

Figure 1:
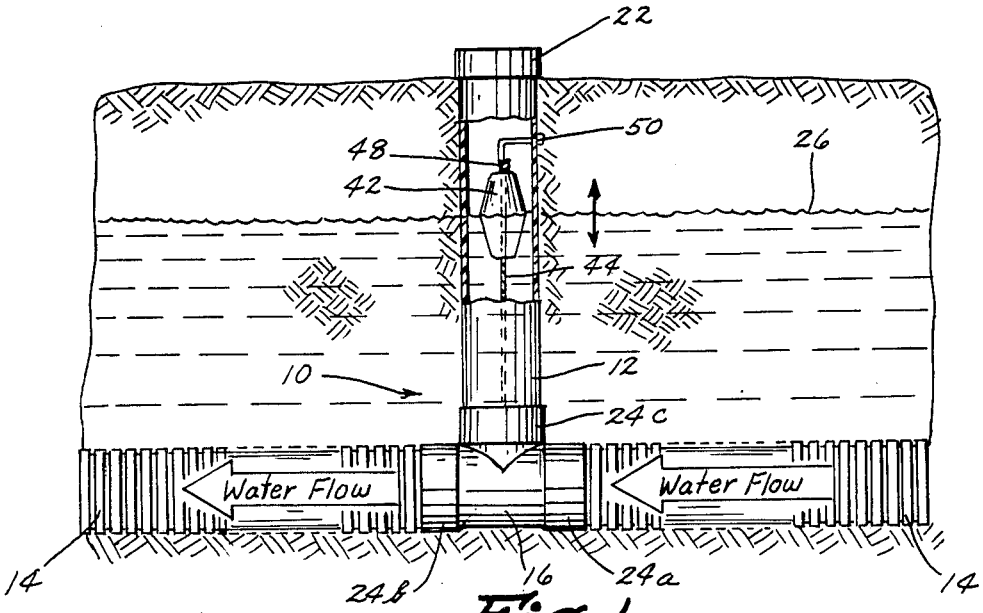
FIG. 1 is a cut away side perspective view illustrating the head control stand in conventional usage with the fluctuation of the water table illustrated by the arrows.

Referring now to the drawings wherein like reference numerials designate identical or corresponding parts throughout the several views, the head control stand is illustrated generally at 10 in FIG. 1.

Figure 2:
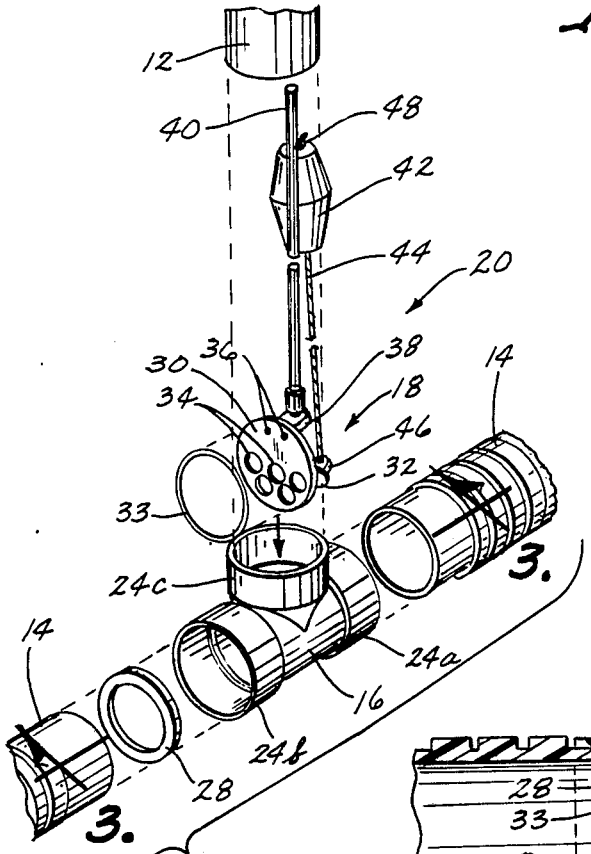
FIG. 2 is a partial exploded view of the head control stand.

Generally, the head control stand 10 (FIGS. 1 and 2) includes a riser pipe 12 connected to a conventional drainage-irrigation tile system 14 by a junction 16. A valve 18 unit is disposed within the junction 16 with an actuating unit 20 attached thereto.

Figure 3:
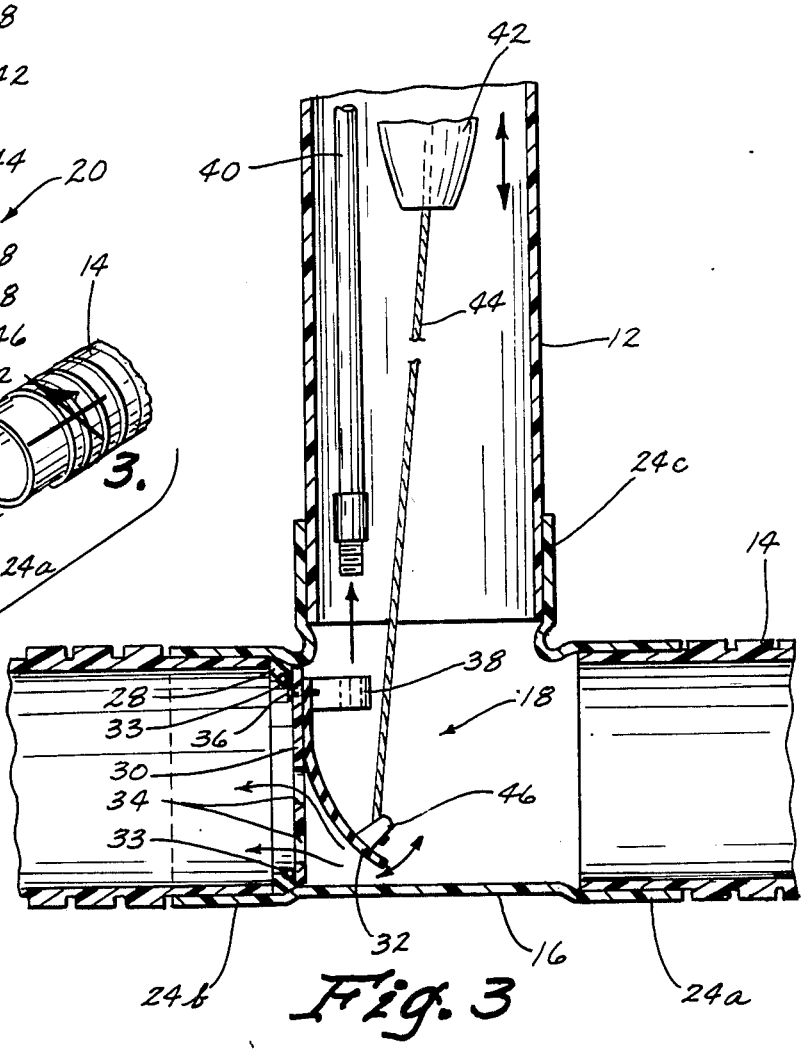
FIG. 3 is a cross sectional view of the head control stand taken along lines 3—3 of FIG. 2.

Specifically, the riser pipe 12 (FIGS. 1–3) is formed from a section of drainage tile, normally PVC, polyethylene pipe or clay tile. The top of the pipe 12 is normally sealed with a cap 22 to prevent foreign material from entering the pipe 12 while still permitting some exchange of air therein to prevent a partial vacuum or pressure from forming from a change in the water table height, with the opposite end of the pipe 12 extending to the junction 16 and securely connected thereto. The junction 16 typically is a three way connector which is connected to the drainage-irrigation tile system 14 and therebetween connected to the riser pipe 12. The junction 16 includes an upstream connecting section 24*a*, a downstream connecting section 24*b* and a section 24*c* which extends normally upwards and between 24*a* and 24*b* into which is connected the riser pipe 12. During the irrigation process significant water is introduced into the drainage/irrigation tile system 14 above the head unit 10 and typically a water table level 26 is established above the system 14. At this time, waterflowing through the drainage/irrigation tile system 14 would enter the junction 16 through the upstream connecting section 24*a* and into the riser pipe 12 and equalize at the same elevation within the riser pipe 12 as the water table within the soil providing the valve 18 is installed in junction 16 and rests in the closed position.

The valve 18 includes a metering plate 30 and flap 32. Further a seal ring 28 fits within the junction 16 adjacent the downstream connecting section 24*b* and provides a base upon which the metering plate 30 and flap 32 rests. The seal ring 28 is typically secured to the junction 16 and is non-removable. The metering plate 30 includes apertures 34 through which water flowing through the drainage/irrigation system 14 may pass. An O-ring surface 33 extends outward from the plate 30 between the plate 30 and seal ring 28 and normally would contact the seal ring 28 to insure a semi-water impermeable seal between the ring 28 15 and plate 30. The O-ring surface 33 may either be directly molded into the plate 30 or of a conventional design with an O-ring grove extending around the plate 30 with a conventional O-ring inserted therein. The flap 32 constructed of pliable inert material is held in place at the top by two 20 conventional nut-bolt assemblies 36 which pass through the plate 30 and flap 32. The flap 32 normally rests against the inside surface of the plate 30 covering the apertures 34 thus preventing water from passing therethrough. The nut-bolt assembly 36 further secures a handle bracket 38 25 into which is threaded to receive a handle 40.

The actuating unit 20 includes a float 42 attached to the flap 32 via a non-rigid flexable cord 44 which is attached at the lower end of the flap 32 by a bracket 46 and to the float by passing therethrough and attached to the adjustable clip 48 at the top of the float 42. The length of the cord 44 extending between the bracket 46 and clip 48 is normally dependent upon the desirable depth of the water table 26. Upon this determination being made, the length of the cord 44 is adjusted to cause the float 42 to rise and open the flap 32 with a corresponding rise in the water table 26. Obviously, the cord 44 should not be elastic and excess cord passes through the side of the riser pipe 12 and is tied off at 50. The float 42 is constructed of water impervious material and with a density less than water such that a portion of the float 42 will ride above the surface of the water.

The valve 18 is typically inserted into the junction 16 after the seed crop has germinated and sufficient root development has occurred. During the early crop growing season, the tile system 14 will be functioning primarily as a drainage system to remove excess in-ground water. At the beginning of the irrigation process, water typically is pumped into the tile system 14 and the head control stand 10 becomes operational by inserting the valve 18 by the handle 40 through the riser pipe 12 to a position between the upstream connecting section 24*a* and downstream connecting section 24*b*. The valve 18 inserted results in the metering plate 30 contacting the seal ring 18 via the O-ring surface 33. This prevents water within the drainage/irrigation tile system 14 from passing between the plate 30 and ring 28. The handle may be removed from the unit completely by being unthreaded from the bracket 38. The maximum water table level for this location is determined and length of the cord 44 extending between the bracket 46 and float 42 is adjusted accordingly by the clip 48. During actual operation of the stand 10, as the level of the water table 26 changes, the level of the water within the riser pipe 12 changes accordingly and the vertical position of the float 42 within the riser pipe 12 similarly changes. In the event the level of the water table 26 moves upward, the float 42 will move upward, thus raising the cord 44 and causing the flap 32 to curl outwards and upwards from the plate 30, permitting water within the tile system 14 to flow through the apertures 34 and out the downstream connecting section 24*b*. As the water flows through the stand 10, the level of the water table 26 will eventually lower with the resulting downward movement of the float 42. As the float 42 moves downward, the flap 32 likewise begins to uncurl to cover more of the metering plate 30 and beings to restrict the flow of water through the apertures 34. When the valve 18 is completely closed, the flap 32 covers the metering plate 30 and seals the apertures 34, thereby preventing water within the drainage/irrigation tile system 14 from flowing therethrough. Further, depending on the degree of change in the water table level 26, the valve 18 is operable proportionately. The level of the water table 26 is thus maintained at a predetermined level within the immediate area of the head control stand 10. The design of the stand 10 is readily adaptable for use with various sized drainage/irrigation tile systems.

The valve 18 may be removed from the drainage/irrigation tile system 14 by reinserting the handle 40 into the bracket 38 and lifting the valve 18 out of the riser pipe 12.

Obviously, many modifications may be made to applicant's invention in light of the above teachings. It is therefore to be understood that the invention may be practiced other than as specifically set forth above and still come within the scope of the appended claims.

We claim:

1. A head control stand for the selective control of an underground water table and the water flow within a subsurface drainage-irrigation tile system in association with a subsurface drainage-irrigation tile system having a drain tile passing through the ground, comprising:

a riser pipe coupled at one end to the drain tile and extending in a generally upright direction;

a junction for coupling the riser pipe to the drain tile, the junction having three couplings, a first upstream coupling connected to a section of drain tile into which water flows, a second downstream coupling connected to a second section of drain tile, the water entering the junction from the first coupling and flowing through the second coupling into the drain tile, a third coupling connected to the riser pipe, the water entering the riser pipe through the third coupling and rising within the riser pipe to a level corresponding to the water table level in the immediate surrounding area;

a valving means removably disposed within the junction for selectively allowing water to flow within the drain tile including a metering plate and a flap, the metering plate sealingly extending across the second coupling and includes apertures, the apertures permitting water to flow through the metering plate, the flap being constructed of flexible material and secured to the metering plate at its top and extending downwardly over the metering plate in a normally closed position covering the apertures to prevent the flow of water therethrough, a bracket, the bracket attached to the lower portion of the flap and extending outwardly therefrom;

actuating unit, the actuating unit located within the riser pipe and includes a float, the float connected to the flap via the bracket such that upon the water table rising, water within the riser pipe will rise and the float will move upward and the flap will be correspondingly pulled away from the metering plate, permitting water within the drain tile to flow through the metering plate and upon the water table lowering, the water level within the riser pipe will lower with the float moving downward and the flap will be correspondingly moved towards the metering plate affectively reducing the flow of water through the metering plate.

2. A head control stand as claimed in claim 1 further comprising:

a seal ring, the seal ring having a configuration generally conforming to the interior of the junction near the second coupling and extending inward therefrom a short distance;

an O-ring grove and O-ring, the O-ring grove extending around the circumference of the metering plate on the side adjacent the second coupling with the O-ring disposed within the O-ring grove and contacting the surface of the sealing ring when the metering plate is positioned within the junction.

3. A head control stand as claimed in claim 1 further comprising a bracket, the bracket secured to the metering plate and threadable receiving a handle, the handle being generally inserted through the riser pipe and threaded onto the bracket for removal of the valving means and actuating unit.

* * * * *